United States Patent [19]

Andrews et al.

[11] 4,270,258

[45] Jun. 2, 1981

[54] METHOD OF RETUBING A STEAM GENERATOR

[75] Inventors: Harry N. Andrews, Export, Pa.; Edmund C. Eglinton, St. Petersburg, Fla.; Joseph W. Gulaskey, N. Huntingdon, Pa.; Leonard J. Balog, Pittsburgh, Pa.; Robert W. Beer, Murrysville, Pa.

[73] Assignee: Westinghouse Electric Corp., Pittsburgh, Pa.

[21] Appl. No.: 974,161

[22] Filed: Dec. 28, 1978

[51] Int. Cl.[2] ..... B23P 7/00

[52] U.S. Cl. ..... 29/157.4; 29/727

[58] Field of Search ..... 29/157.3 R, 157.4, 726, 29/727

[56] References Cited

U.S. PATENT DOCUMENTS

| | | | |
|---|---|---|---|
| 3,703,028 | 11/1972 | Bosquain et al. | 29/726 |
| 3,958,698 | 5/1976 | van der Woerd | 29/726 |
| 4,155,158 | 5/1979 | Folch | 29/729 |
| 4,173,060 | 11/1979 | Massaro et al. | 29/157.4 |

*Primary Examiner*—Lowell A. Larson

*Attorney, Agent, or Firm*—F. J. Baehr, Jr.

[57] ABSTRACT

A method of rapidly retubing a steam generator while it is vertically oriented in a containment vessel and keeping the level of radiation to which workmen are subjected at a minimal level.

10 Claims, 10 Drawing Figures

METHOD OF RETUBING A STEAM GENERATOR

BACKGROUND OF THE INVENTION

1. Field of the Invention

This invention relates to retubing a nuclear steam generator and more particularly to retubing a nuclear steam generator, while it is vertically oriented in a containment vessel.

2. Description of the Prior Art

Two allowed applications entitled, "Methods for Retubing a Steam Generator" were filed by the assignee of this invention on Feb. 2, 1977 and Sept. 19, 1977, and were given the respective Ser. Nos. 765,030 now U.S. Pat. No. 4,135,701 granted Jan. 23, 1979, and 834,855. These applications describe early conceptual methods of retubing. The method described hereinafter is a refinement of these earlier methods and has the advantage of being a method, which was tested on an actual steam generator disposed in a simulated containment vessel. The steps have been refined and set in a particular order to complete retubing and upgrading a steam generator in a time frame of 62 to 77 days without exposing personnel to excessive levels of radiation.

SUMMARY OF THE INVENTION

In general, a method of retubing a steam generator, when it is vertically oriented in a containment vessel, comprises the steps of installing alignment clips on an enlarged portion of the shell so that they bridge a circumferential line on which the shell will be parted, and cutting on the circumferential line, a groove all the way through the shell. The groove is cut to the configuration of a weld preparation for rewelding the shell back together. The method further comprises removing the upper portion of the shell, cutting the dome free from the wrapper and removing it therefrom, and enclosing the upper end of the shell with a cask large enough to accept the tube bundle and wrapper. The cask has a hoist for supporting and lifting the tube bundle. The method also comprises the steps of cutting the channel blocks to free the wrapper from the shell, cutting openings in the shell and wrapper above the tubesheet to provide access to the tube bundle adjacent the upper side of the tubesheet, cutting the tubes above the tubesheet to free the tube bundle, raising the tube bundle and wrapper into the cask, and sealing the lower end of the cask. The tube bundle, wrapper and cask are then removed from the shell. The method also includes installing a remotely controlled tool in each chamber of the head. The remotely controlled tool is capable of performing various operations on the ends of the tubes and holes in the tubesheet including cutting the seal welds between the tube and tubesheet and refurbishing the holes in the tubesheet. With the seal welds cut, the stub ends of the tubes are removed from the tubesheet. A new wrapper and tube support system is installed in the shell and then the tubes are installed in the support system and tubesheet one or more rows at a time. The tubes are expanded into engagement with the tubesheet, the ends are seal welded to the tubesheet and finally the upper portion of the shell is aligned and welded in place. The welds are heat treated and inspected and finally the shell is hydrostatically tested and ready for operation.

BRIEF DESCRIPTION OF THE DRAWINGS

The objects and advantages of this invention will become apparent from reading the following detailed description in connection with the accompanying drawings, in which.

DESCRIPTION OF THE PREFERRED EMBODIMENT

Figure 1:
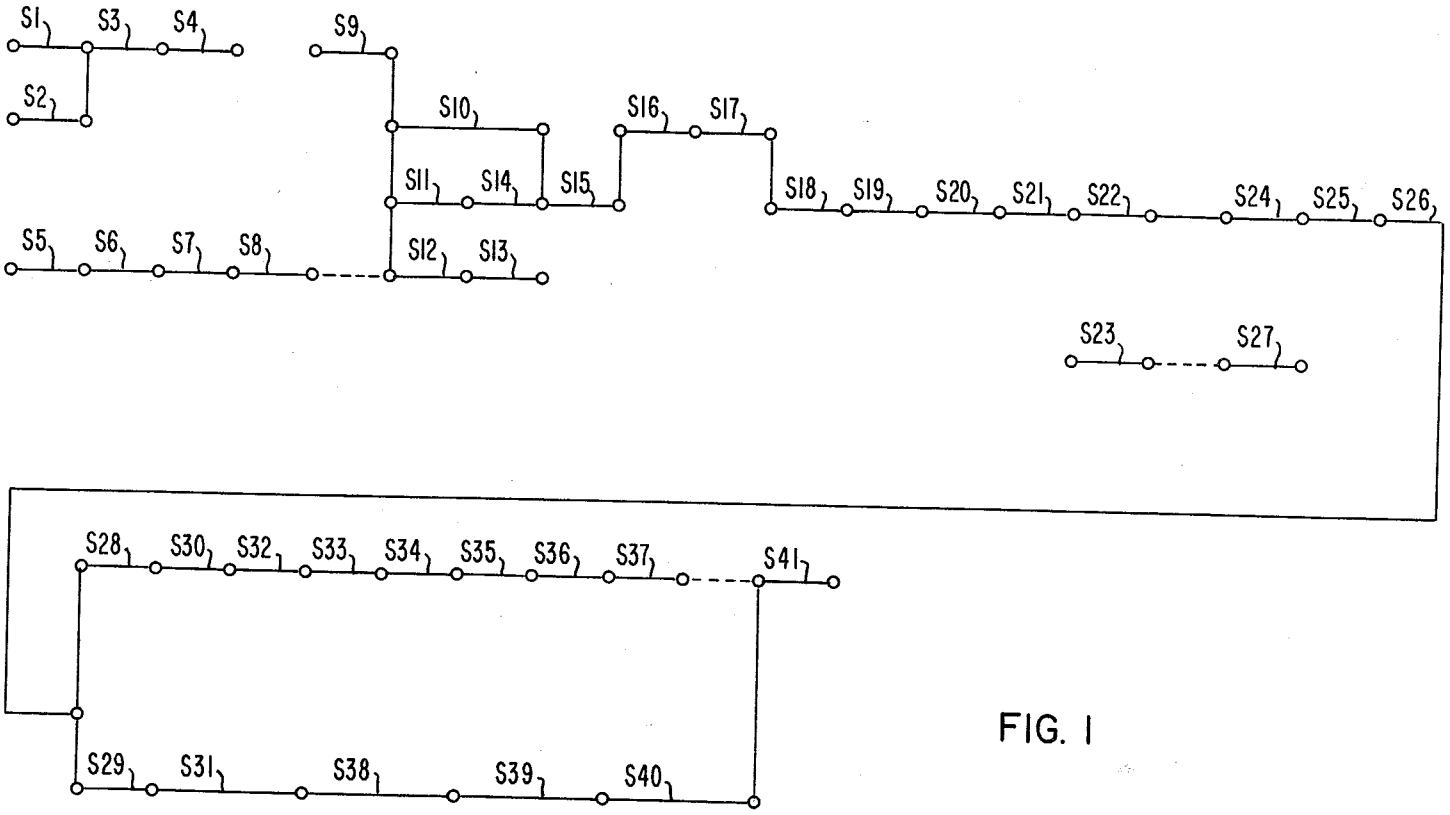
FIG. 1 is a critical path diagram of a method for retubing a steam generator while it is vertically oriented in a containment vessel.
Figure 2:
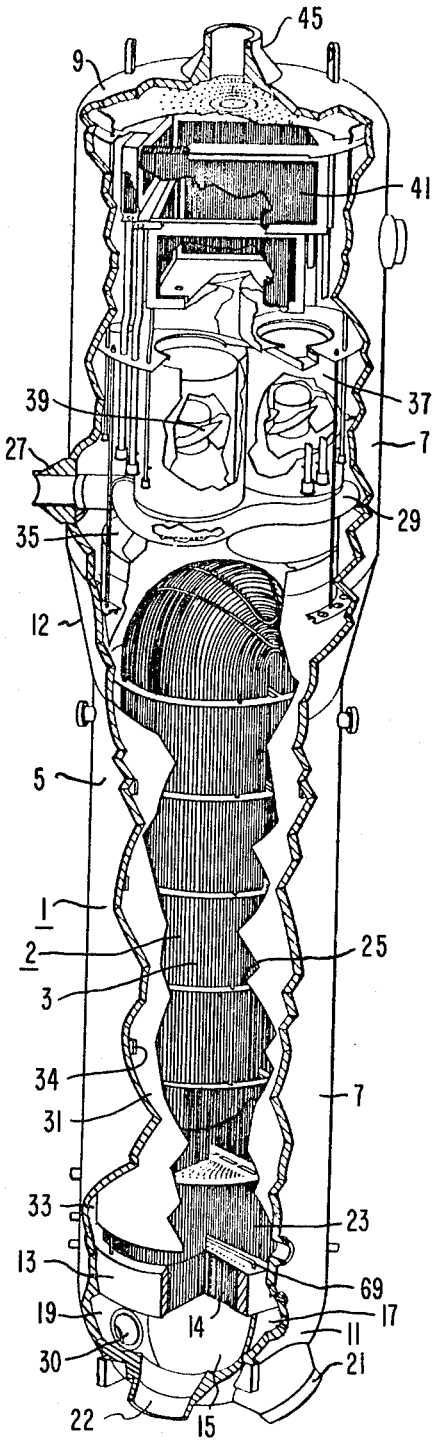
FIG. 2 is a perspective view partially in section of the steam generator.

Referring now to the drawings in detail and in particular to FIG. 2, there is shown a steam generator 1 which utilizes a bundle 2 of closely packed U-shaped tubes 3 to provide the heating surface required to transfer heat from a primary fluid to vaporize or boil a secondary fluid. The steam generator 1 comprises a vessel 5 having a vertically-oriented tubular shell portion 7 and an end closure or flanged and dished head 9 enclosing one end of the shell 7, the upper end and a spherically shaped channel head 11 enclosing the other end of the shell 7, the lower end. The lower portion of the shell 7 is smaller in diameter than the upper portion and an frustoconical shape transition member 12 connects the upper and lower portions. A tubesheet 13 is made integral with the channel head by welding and has a plurality of holes 14 disposed therein to receive ends of the U-shaped tubes 3. A dividing plate 15 is centrally disposed in the channel head 11 to divide the channel head into two compartments 17 and 19, which serve as headers for the tubes. The compartment on the right as shown in FIG. 1 is the primary fluid inlet compartment 17 and has a primary fluid inlet nozzle 21 in fluid communication therewith. The compartment on the left, as shown in FIG. 1, is the primary fluid outlet compartment 19 and has a primary fluid nozzle 22 disposed in fluid communication therewith, thus allowing the primary inlet fluid to flow through the tubes thereby creating a hot leg portion 23, the portion shown on the right in the drawings and a cool leg portion 25, the portion shown on the left in the drawing. A secondary fluid or feed water inlet nozzle 27 is disposed in the upper portion of the shell 7 above the tube bundle 2 and has a ring header 29 in fluid communication therewith. The compartments 17 and 19 each have a manway 30 disposed therein; however, in FIG. 2, only the manway 30 in the compartment 19 is shown.

The tube bundle 2 is encircled by a wrapper 31 which encloses the tube bundle and forms an annular chamber 33 between the wrapper 31 and the shell 7. The wrapper 31 is supported from the shell by channel blocks 34 and has an upper cover for domed head 35 disposed above the bends of the tubes 3. The domed head 35 has a plurality of openings in communication with sleeves 37 which have swirl vanes 39 disposed therein to cause the steam flowing upwardly therethrough to spin and centrifugally remove some of the moisture contained therein. After flowing through the centrifugal separators, the steam then passes through a chevron separator 41 before reaching a secondary fluid outlet nozzle 45 centrally disposed in the flanged and dished head 9. The ring header 29 encircles the centrifugal separator comprising three loops generally forming a clover leaf shaped ring.

The method of retubing the steam generator 1 while it is vertically oriented in a containment vessel, comprises the following steps, which are represented by the reference characters S1 through S41 in the critical path diagram shown in FIG. 1. The length of the lines are indicative of the time required to perform the steps which are disposed to indicate their sequential relative time frame in the retubing operation.

Figure 3:
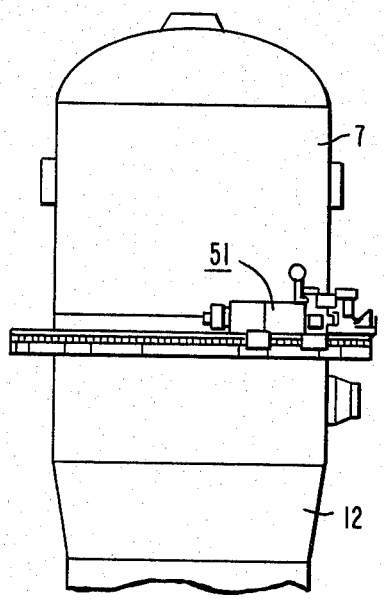
FIG. 3 is a partial elevational view of a steam generator showing a tool utilized for parting the steam generator and laying down the weld to rejoin the steam generator.

The first step S1 comprises installing a narrow groove cutting and welding track and tool 51 on the upper portion of the shell 7 above the transition member 12 and above the feedwater nozzle 27, as shown in FIG. 3. For a more complete description of the tool 51 reference may be made to an application filed by the assignee of this application May 10, 1978 and assigned Ser. No. 904,686, which application is hereby incorporated by reference.

Simultaneously with the installation of the tool 51 as set forth in step S1, the step S2 commences and comprises installing alignment clips on the enlarged portion of the shell 7. The alignment clips bridge a circumferential line on which the shell 7 is to be parted.

Upon completion of steps S1 and S2, the step S3 commences and comprises cutting, on the circumferential line, a groove all the way through the shell 7. The groove is cut to the configuration of a weld preparation for rewelding the shell 7 back together. Preferably, the groove configuration is that required to make a narrow groove weld.

Figure 6:
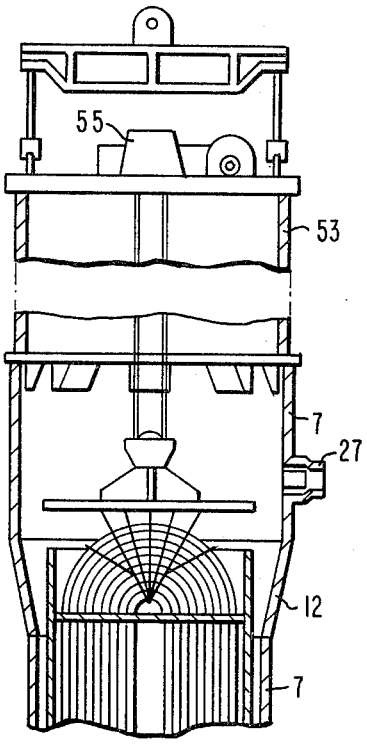
FIG. 6 is a sectional view of a cask disposed on the upper portion of the steam generator.
Figure 8:
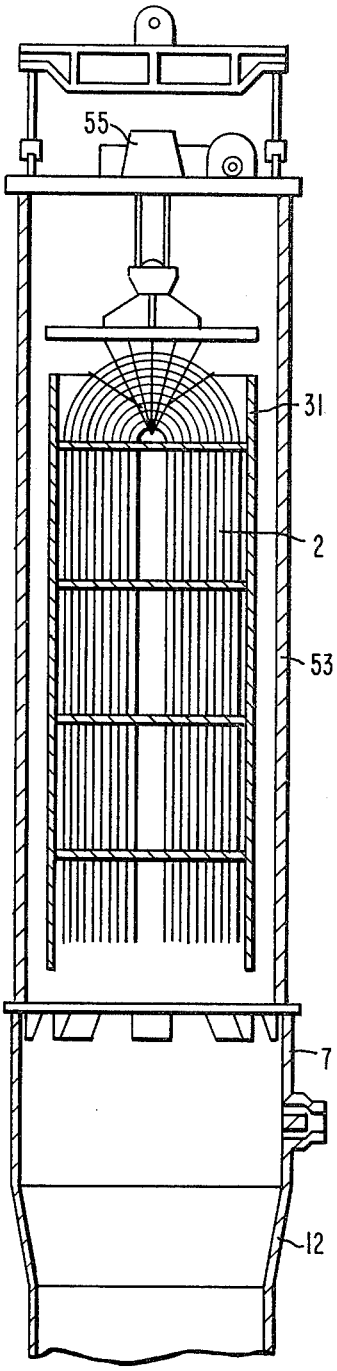
FIG. 8 is a sectional view of a cask with a tube bundle and wrapper disposed therein.
Figure 7:
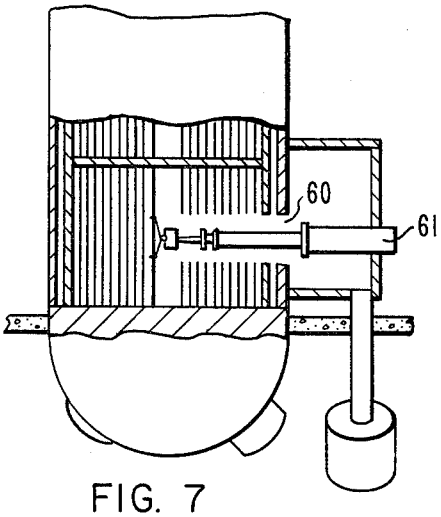
FIG. 7 is an elevational view partially in section showing a tool for cutting through the tube bundle.
Figure 9:
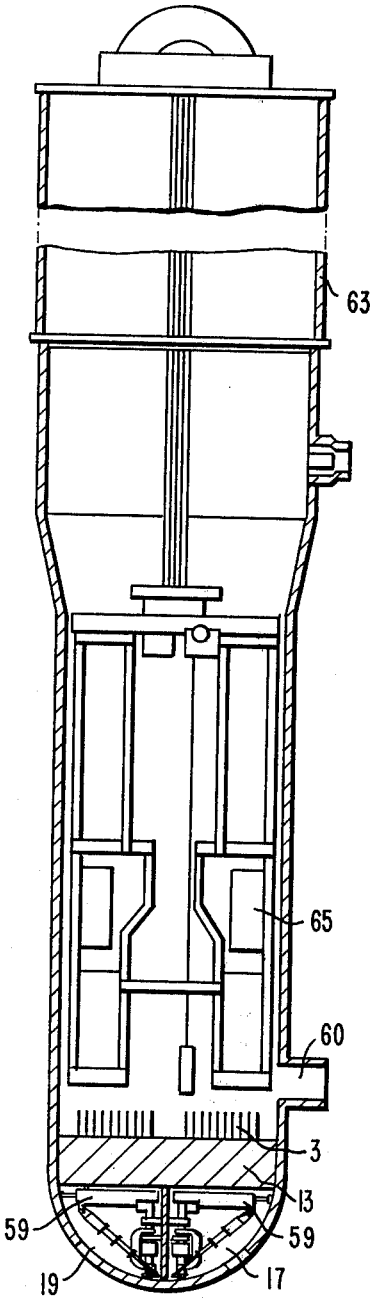
FIG. 9 is a sectional view of a portion of the steam generator showing a gondola utilized to remove the stub ends of the tubes.

After having cut through the shell 7, the step S4 which includes removing the upper portion of the shell 7, placing it in the containment vessel, removing the feedwater inlet ring 29, the dome 35 of the wrapper 31, and installing a cask 53 on the upper end of the shell 7 can be undertaken. A generally air-tight seal is provided between the cask 53 and the shell 7 to prevent radioactive dust and debris from escaping from the shell. The cask 53, as shown in FIG. 6, has a hoist 55 or other lifting means disposed therein for supporting and lifting the tube bundle 2 after it is freed from the tubesheet 13. For detailed information concerning the cask 53 and hoist 55, reference may be made to an application filed by the common assignee May 1, 1978 and assigned Ser. No. 901,659, which application is hereby incorporated by reference.

Simultaneous with the beginning of steps S1 and S2, step S5 commences and comprises opening manways 30 in the head 11, installing a temporary seal to close off the inlet and outlet nozzles 21 and 22, installing semiautomatic decontaminating equipment in each compartment 17 and 19 of the head 11, and decontaminating each compartment 17 and 19 of the head 11. The temporary nozzle seals are removed from the inlet and outlet nozzles 21 and 22 and permanent nozzle seal rings are installed along with nozzle seals which constitute step S6. For a detailed description of the method and equipment utilized to decontaminate each compartment 17 and 19 of the head 11, reference may be made to an application filed by the assignee Aug. 1, 1978 and assigned Ser. No. 930,091, which application is hereby incorporated by reference.

Figure 4:
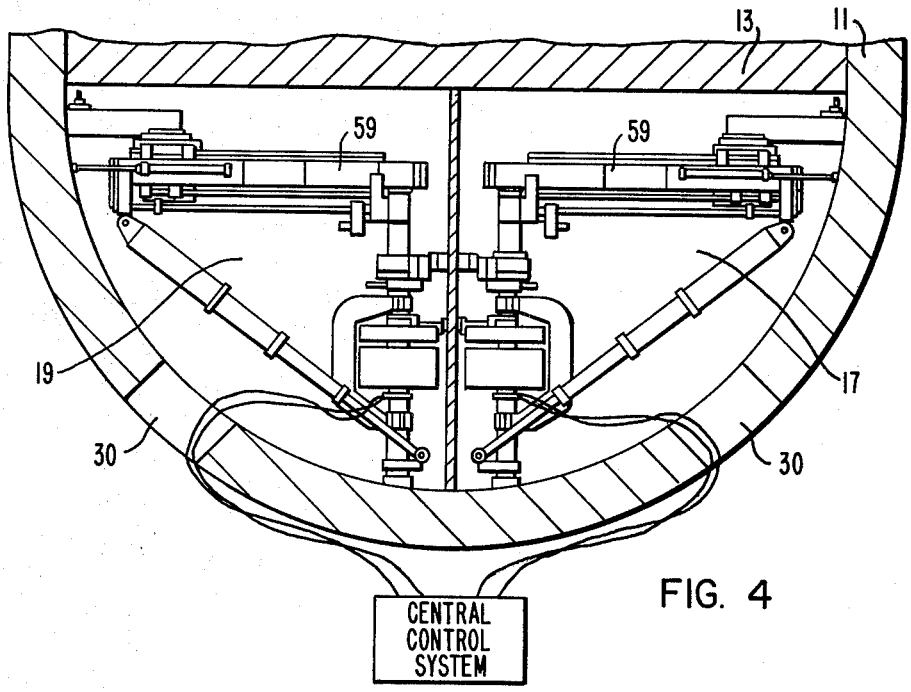
FIG. 4 is a partial sectional view of a steam generator with remotely operated tools which perform various operations on the tubesheet and tubes disposed in each section of the head.

Even though each compartment of the head 11 has been decontaminated, the tubes 3 emit sufficiently high levels of radiation, that the time requred for anyone working in the head 11 to receive his allotted amount of radiation would still be short. Therefore, the next step S7 includes installing and aligning with the tubesheet a remotely-controlled tool 59, which can perform various operations on all of the tubes 3 and holes 14 in the tubesheet 13 in each compartment 17 and 19 of the head 11. FIG. 4 shows the tools 59 disposed in the head 11; however, for a detailed description of an applicable tool 59, reference may be made to an application filed by the assignee Mar. 21, 1978 and assigned Ser. No. 888,701.

After completion of the step S7, step S8 commences and includes mapping the location of the tubes 3 and tube holes 14 in both compartments 17 and 19 and storing this information so that the tool 59 may move rapidly from tube to tube and perform various operations thereon. For a detailed description of the controls of the tool 59, reference may be made to an application, filed by the assignee Oct. 18, 1978 and assigned Ser. No. 952,431, which application is hereby incorporated by reference.

The next step is step S9 and comprises draining and removing all water from the shell 7. With the water removed from the shell, steps S10, S11 and S12 may commence simultaneously.

Step S10 comprises cutting the wrapper 31 loose from the shell 7 by burning through the channel blocks 34 which support the wrapper 31 from the shell 17, utilizing a burning tool, which fits into the space 33 between the wrapper 31 and the shell 7.

Figure 5:
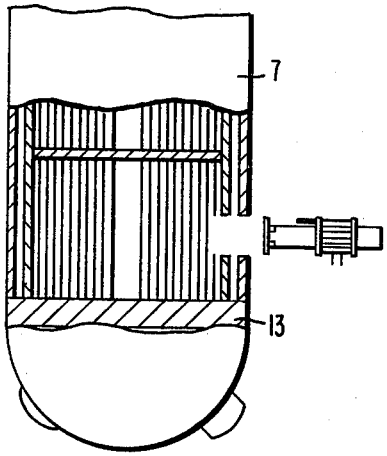
FIG. 5 is an elevational view partially in section of the lower portion of the steam generator showing a tool for cutting openings in the shell and wrapper.

Step S11 comprises cutting an opening 60 in the shell 7 and wrapper 31 adjacent the tubesheet 13 to provide access to the tubes 3 adjacent the tubesheet as shown in FIG. 5.

Step S12 includes drilling plugs and cutting away the welds between the tubes 3 and tubesheets 11, after the completion of which step S13 commences and comprises removing the tools 59 from the chambers 17 and 19.

After the completion of step S11, cutting the openings in the shell, step S14 commences and comprises installing tube-cutting equipment 61 which is followed by step S15 which comprises cutting the tubes 3 adjacent the tubesheet 13 utilizing a pair of cutters which cut out a small segment from the tubes 3 and move toward each other as they progress through the tube bundle 2 as set forth in detail in application filed by the assignee Oct. 23, 1978 and assigned Ser. No. 954,041, which application is hereby incorporated by reference.

With the tube bundle 2 and wrapper 31 cut free, step S16 commences and includes removing the tube bundle 2 and wrapper 31 from the shell 7 by raising them into the cask, sealing the lower end of the cask 53, and removing the cask 53 along with the tube bundle 2 and wrapper 31 and placing them in the containment vessel.

With the cask 53 removed, step S17 commences and comprises installing a hood or cover 63 on the upper end of the shell 7, the hood or cover 63 containing a gondola or controlled environment work station 65 which can be lowered into the shell 7 to perform various operations therein and protect workmen from the radioactive environment. For a detailed description of the hood 63 and gondola 15, reference may be made to an application filed by the assignee Apr. 14, 1978 and assigned Ser. No. 896,531, which application is hereby incorporated by reference.

The gondola 65 is utilized to bring workmen enclosed within a safe environment in proximity of the tubesheet to perform step S18, which comprises pulling the stub ends of the tubes 3 from the tubesheet 13 utilizing a hydraulic tube puller or other suitable means. If the tubes 3 have been expanded the full length that they are coextensive with the tubeshet 13, it may be necessary to shrink the tubes 3 by heating at least a portion thereof so that they yield and later shrink, when they cool, or cut deep grooves into the tubes 3 so that they may be pulled from the tubesheet 13.

After the stub ends of the tubes 3 have been removed, step S19 commences and comprises decontaminating the secondary side of the steam generator 1 or the inside of the shell 7 and upper portion of the tubesheet 13.

With the shell 7 decontaminated, step S20 commences and comprises refurbishing and reworking the upper side of the tubesheet. For a detailed description of a tool which may be utilized in the refurbishing and reworking operation, reference may be made to an application filed by the assignee Apr. 17, 1978 and assigned Ser. No. 896,869, which application is hereby incorporated by reference.

The next step, S21, commences and comprises refurbishing the holes 14 in the tubesheet 13 which includes honing the holes utilizing a flexi-hone or other honing device. A flexi-hone is a round brush with abrasive material disposed on the end of each bristle.

After the holes 14 have been refurbished, steps 22 commences and comprises installing shear lugs in the shell 7 to support the wrapper 31 from the shell and installing blow-down lines 69 adjacent the tubesheet 13, both installations are performed utilizing welding operations. As the decontamination of the shell is being completed in steps 19, steps 23 commences and includes fitting manway forgings in the openings 68 cut in the shell 7 above the tubesheet 13, preheating the forgings and welding the forgings to the shell 7, and ultrasonically testing the welds.

After the completion of all welding to and in the shell, step S24 commences and comprises cleaning the tubesheet 13 and holes 14 therein with steam and distillate to remove all debris therefrom.

Then, step 25 commences and includes post weld heat treatment of the shear lugs and manways.

upon completion of the heat treatment of the shell, step S26 commences and comprises recleaning the tube holes utilizing hones, vacuuming and finally swabbing each hole to ensure its finish and cleanliness.

While step S26 is being performed, steps 27 also commences and is completed and comprises inspecting the manway welds utilizing X-ray techniques.

After the final tube hole cleaning as set forth in step S26, steps 28 and 29 commence simultaneously. Step S28 comprises installing the wrapper 31 and tube support plates in the shell 7. For a detailed description of the wrapper 31 and how it is installed in the shell 7, reference may be made to an application filed by the assignee Aug. 14, 1978 and assigned Ser. No. 933,335, which application is hereby incorporated by reference. Step S29 comprises re-installing the remotely controlled tool 59, cleaning the underside of the tubesheet 13 by wire brushing and spot facing the tubesheet 13 around each hole 14 utilizing the tool 59.

Figure 10:
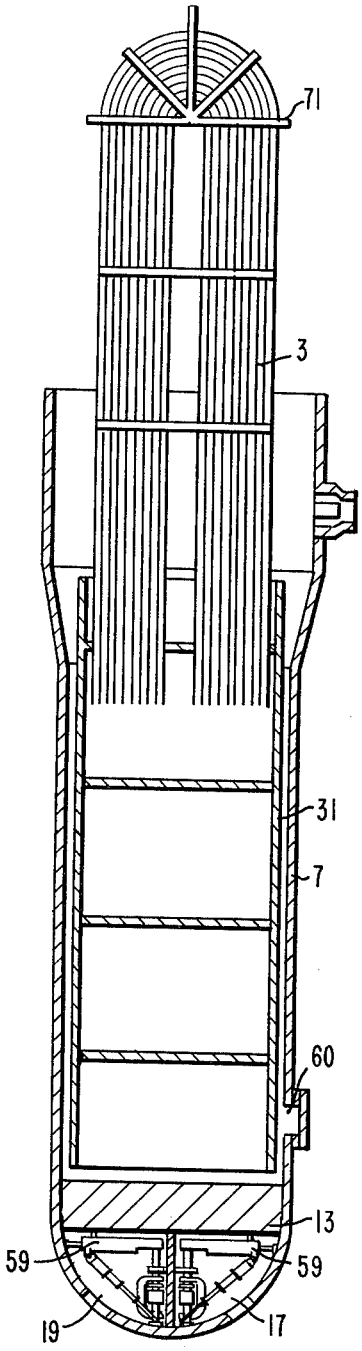
FIG. 10 is a sectional view showing a row of tubes being installed in the steam generator.

With the wrapper 31 installed and the area around the holes 14 spot faced, step S30 may commence and comprises installing the tubes 3 which are installed at least one row at a time, but preferably two rows at a time. As shown in FIG. 10, two rows of tubes are disposed in a rack 71 which positions the tubes 3 in the relative positions in which they will be disposed when positioned in the steam generator 1 and guide plugs are placed in the ends of the tubes to assist the tubes to enter holes in the support plates and tubesheet 13 as the rows of tubes 3 are lowered in place. For a more complete description of the apparatus and method utilized to load one or more rows of tubes simultaneously, reference may be made to an application filed by the assignee Nov. 29, 1978 and assigned Ser. No. 965,017, which application is hereby incorporated by reference.

After the first row of tubes is installed, step 31 commences and comprises removing the guide plugs from the tubes 3, positioning the ends of the tubes 3, and tack rolling the tubes 3 in the tubesheet 13. Each tube 3 is held in position by the tool 59 and the tool 59 removes the guide plug and positions each tube 3 with respect to the previously-machined spot face. It is necessary that the shortest leg of the U-shaped tube be tack rolled in position first and then the tool 59 on the other side of the tubesheet 13 raises the long leg in position and tack rolls it in place. The operation on both sides of the channel head 11 work in unison with duplicate tools 59 performing the work on each side of the channel head 11. Anti-vibration bars are installed after tack rolling every twelfth row of tubes 3 until the tube bundle 2 is completely assembled. For a more complete description of the tool 59 and method utilized to position and tack roll the tubes 3, reference may be made to an application filed by the assignee Oct. 18, 1978 and assigned Ser. No. 952,430.

After the installation of the tubes as set forth in step S31 is complete, step S32 commences and comprises welding the dome on the wrapper 31, installing the feedwater ring in the upper portion of the shell and installing all other internal portions of the steam generator in preparation of replacing the upper portion of the shell 7.

Then, step S33 commences and comprises aligning and installing the upper portion of the shell 7.

After the upper portion of the shell 7 has been properly aligned with the lower portion, step 34 commences and comprises welding the upper portion of the shell to the lower portion preferably utilizing narrow groove techniques to minimize the amount of weld metal utilized and produce as high a grade weld as is possible without extensive reworking of the weld.

After the welding operation, step S35 commences and comprises surface grinding the weld and inspecting its soundness utilizing ultrasonic and visual techniques.

If the weld is sound, step S36 commences and comprises heat treating the weld after which step S37 commences and comprises retesting the weld to assure its soundness.

After the tubes 3 are positioned and tack rolled in place as described in step S31, step S38 commences and comprises seal welding the ends of the tubes 3 to the tubesheet 13 utilizing the remote control tool 59. Upon completion of the seal welding operation, step 39 commences and comprises hydraulically expanding the tubes 3 into engagement with the tubesheet 13 generally the entire extent that the tubes 3 and tubesheet 13 are coextensive. For a more detailed description of hydraulic expanding apparatus and methods, reference may be made to applications filed by the assignee Apr. 14, 1978 and assigned Ser. No. 896,532, now U.S. Pat. No. 4,159,564 granted July 3, 1979, and the application filed Sept. 5, 1978 by the assignee and assigned Ser. No. 939,553.

Step S40 may now commence and comprises nondestructive evaluation and testing of the welds between the tubes 3 and the tubesheet 13.

When all of the welds have been tested, the final step S41 may commence and includes buttoning up the shell side of the steam generator 1 and performing a hydrostatic test on the shell side thereof, after which the steam generator 1 is ready for service.

The method hereinbefore described demonstrates that a steam generator can be retubed while it is vertically oriented in a containment vessel generally in a lapse time of 62 to 77 days following the sequential steps hereinbefore described.

Due to the current needs for field maintenance and major repairs of steam generators, a program has been initiated to develop the capability of field retubing, which includes the upgrade and repair of steam generators with a minimal amount of down time and a minimal exposure of personnel to radiation.

A full scale demonstration was conducted in a specially-designed structure which was built to simulate the limited access and lay-down space of a containment vessel. Although the full size steam generator, which was retubed, was not radioactively hot, it was worked as though it were, in order to demonstrate that a steam generator could be retubed and repaired utilizing remotely controlled tools in a time frame of approximately 62 to 77 days without excessive exposure of personnal to the radioactive environment associated with steam generators that have been in service in a nuclear power plant.

We claim:

1. A method of retubing a steam generator having a shell with an enlarged upper portion, a tubesheet disposed adjacent the lower end of the shell, a plurality of U-shaped tubes seal welded to the tubesheet and extending upwardly therefrom to form a closely-packed tube bundle, a head divided into an inlet and outlet compartment, each compartment having a manway and respectively an inlet and outlet nozzle, a wrapper with a dome on the upper end thereof, the wrapper being disposed between the shell and the tube bundle and blocks which support and space the wrapper from the shell while the steam generator is vertically oriented in a containment vessel, said method comprising the steps of:

installing alignment clips on the enlarged portion of the shell bridging a circumferential line on which the shell is to be parted;

cutting, on said circumferential line, a groove all the way through the shell, the groove being cut to the configuration of a weld preparation for rewelding the shell back together;

removing the upper enlarged portion of the shell;

cutting the dome from the wrapper and removing it therefrom;

enclosing the upper end of the shell with a cask large enough to accept the tube bundle and wrapper and having a hoist for supporting and lifting the tube bundle;

cutting the blocks to free the wrapper from the shell;

cutting openings in the shell and wrapper above the tubesheet to provide access to the tube bundle adjacent the upper side of the tubesheet;

cutting the tubes above the tubesheet to free the tube bundle;

raising the tube bundle and wrapper into the cask;

sealing the lower end of the cask;

removing the cask, tube bundle and wrapper from the shell;

installing a remotely controlled tool in each chamber of the head, the remotely controlled tool being capable of performing various operations on the ends of all of the tubes and holes in the tubesheet;

cutting the seal welds between the tubes and tubesheet utilizing the remotely controlled tool;

removing the stub ends of the tubes from the tubesheet;

refurbishing the holes in the tubesheet;

installing a new wrapper and tube support system in the shell;

installing simultaneously one or more rows of tubes in the support system and tubesheet until all of the tubes are installed;

expanding at least a portion of the tubes into engagement with the holes in the tubesheet as they are installed therein;

seal welding the ends of the tubes to the tubesheet;

aligning the upper portion of the shell with the lower portion thereof;

welding the upper portion of the shell to the lower portion;

inspecting the weld joining the upper and lower portions of the shell;

heat treating the weld joining the upper and lower portions of the shell;

closing the holes cut in the shell above the tubesheet; and testing the shell hydrostatically.

2. The method as set forth in claim 1 and further comprising the steps of installing a hood which encloses the upper portion of the shell and has a protected environment gondola disposed therein, which can be lowered into the shell; utilizing the gondola to bring workmen enclosed therein in a protected environment in proximity of the tubesheet to perform work thereon; and removing the gondola and hood from the shell.

3. The method as set forth in claim 1, wherein the step of cutting a groove all the way through the shell includes cutting a groove suitable for narrow gap welding.

4. The apparatus set forth in claim 1 and further comprising the step of expanding the tubes into engagement with the tubesheet generally a full extent to which the tubes and tubesheet are coextensive.

5. The method set forth in claim 1, wherein the step of refurbishing the tube holes comprises honing the holes.

6. The method set forth in claim 1 and further comprising the steps of decontaminating the inlet and outlet compartments in the head and decontaminating the inner side of the shell and the upper surface of the tubesheet after the tube bundle and stub ends have been removed from the tubesheet.

7. The method as set forth in claim 1 and further comprising the steps of placing a guide plug in the ends of the tubes prior to installing the rows of tubes in the tube support system and tubesheet and removing the guide plug from the tubes prior to seal welding the ends of the tubes to the tubesheet.

8. The method set forth in claim 1 and further comprising the step of tack rolling the tubes into engagement with the tubesheet prior to seal welding the tubes to the tubesheet.

9. The method set forth in claim 1 and further comprising the step of determining which leg of the U-shaped tube is shortest and expanding at least a portion of the end of that leg into engagement with the tubesheet, then pushing up the other leg of the tube to its proper position and expanding at least a portion of its end into engagement with the tubesheet.

10. The method as set forth in claim 1, wherein the step of closing the holes cut in the shell above the tubesheet comprises installing manways and removable covers therefor.

* * * * *